US006783290B2

(12) United States Patent
Sussmeier

(10) Patent No.: US 6,783,290 B2
(45) Date of Patent: Aug. 31, 2004

(54) METHOD AND SYSTEM FOR HIGH SPEED DIGITAL METERING USING LOW VELOCITY PRINT TECHNOLOGY

(75) Inventor: John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 118 days.

(21) Appl. No.: 10/213,204

(22) Filed: Aug. 5, 2002

(65) Prior Publication Data

US 2004/0021755 A1 Feb. 5, 2004

(51) Int. Cl.[7] ..... B41J 13/08

(52) U.S. Cl. ..... 400/608.4; 271/3.18; 271/3.21; 271/270; 400/605; 400/607

(58) Field of Search ..... 400/578, 605, 400/607, 608.2, 608.4; 347/104, 215; 271/3.14, 3.18, 3.21

(56) References Cited

U.S. PATENT DOCUMENTS 4,573,673 A * 3/1986 Haug ..... 271/111
4,935,078 A * 6/1990 Bergman et al. ..... 156/64
5,471,928 A * 12/1995 Dimur et al. ..... 101/235
6,607,190 B1 * 8/2003 Guiles et al. ..... 271/4.03
6,644,660 B2 * 11/2003 Sussmeier et al. ..... 271/270

FOREIGN PATENT DOCUMENTS

JP 02270740 A * 11/1990 ..... B65H/5/06
JP 10006583 A * 1/1998 ..... B41J/11/42

* cited by examiner

*Primary Examiner*—Daniel J. Colilla
(74) *Attorney, Agent, or Firm*—Michael J. Cummings; Charles R. Malandra, Jr.; Angelo N. Chaclas

(57) ABSTRACT

A system and a method to control the motion of envelopes within a postage printing module to accommodate the use of slower print techniques and to achieve high throughput in a mail processing system. The system transports envelopes according to a motion profile in which the envelope is decelerated from a transport velocity to a slower printing velocity. After the printing operation has been completed, the envelope is accelerated back to the transport velocity and transferred to a downstream module. None of the intervals of deceleration, low print velocity, or acceleration may occur while an envelope in the postage printing module is also in the control of another module. The print head is geared to operate in synchronism with the print transport. Further, upon the occurrence of an error condition, such as a jam, the print transport is decelerated to a stop in such a manner as to preserve the spacing between subsequent envelopes to be the same as if no error condition had occurred. Displacement motion of the print transport during a stoppage or restarting is therefore controlled as a predetermined function, or set of functions, of the displacement of other modules in the system.

15 Claims, 2 Drawing Sheets

METHOD AND SYSTEM FOR HIGH SPEED DIGITAL METERING USING LOW VELOCITY PRINT TECHNOLOGY

TECHNICAL FIELD

The present invention relates to a module for printing postage value, or other information, on an envelope in a high speed mass mail processing and inserting system. Within the postage printing module, the motion of the envelope is controlled to allow high envelope throughput, even if the postage printing device operates at a lower velocity than other parts of the system.

BACKGROUND OF THE INVENTION

Inserter systems such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series and 9 series inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Current mail processing machines are often required to process up to 18,000 pieces of mail an hour. Such a high processing speed may require envelopes in an output subsystem to have a velocity in a range of 80–85 inches per second (ips) for processing. Consecutive envelopes will nominally be separated by a 200 ms time interval for proper processing while traveling through the inserter output subsystem. At such a high rate of speed, system modules, such as those for sealing envelopes and putting postage on envelopes, have very little time in which to perform their functions. If adequate control of spacing between envelopes is not maintained, the modules may not have time to perform their functions, envelopes may overlap, and jams and other errors may occur. In particular, postage meters are time sensitive components of a mail processing system. Meters must print a clear postal indicia on the appropriate part of the envelope to meet postal regulations. The meter must also have the time necessary to perform the necessary bookkeeping and calculations to ensure the appropriate funds are being stored and printed.

A typical postage meter currently used with high speed mail processing systems has a mechanical print head that imprints postage indicia on envelopes being processed. Such conventional postage metering technology is available on Pitney Bowes R150 and R156 mailing machines using model 6500 meters. The mechanical print head is typically comprised of a rotary drum that impresses an ink image on envelopes traveling underneath. Using mechanical print head technology, throughput speed for meters is limited by considerations such as the meter's ability to calculate postage and update postage meter registers, and the speed at which ink can be applied to the envelopes. In most cases, solutions using mechanical print head technology have been found adequate for providing the desired throughput of approximately five envelopes per second to achieve 18,000 mail pieces per hour.

However, use of existing mechanical print technology with high speed mail processing machines presents some challenges. First, some older mailing machines were not designed to operate at such high speeds for prolonged periods of time. Accordingly, solutions that allow printing to occur at lower speeds may be desirable in terms of enhancing long term mailing machine reliability.

Another problem is that many existing mechanical print head machines are configured such that once an envelope is in the mailing machine, it is committed to be printed and translated to a downstream module, regardless of downstream conditions. As a result, if there is a paper jam down stream, the existing mailing machine component could cause even more collateral damage to envelopes within the mailing machine. At such high rates, jams and resultant damage may be more severe than at lower speeds. Accordingly, improved control and lowered printing speed, while maintaining high throughput rate in a mechanical print head mailing machine could provide additional advantages.

Controlling throughput through the metering portion of a mail producing system is also a significant concern when using non-mechanical print heads. Many current mailing machines use digital printing technology to print postal indicia on envelopes. One form of digital printing that is commonly used for postage metering is thermal inkjet technology. Thermal inkjet technology has been found to be a cost effective method for generating images at 300 dpi on material translating up to 50 inches per second. Thus, while thermal inkjet technology is recognized as inexpensive, it is difficult to apply to high speed mail production systems that operate on mail pieces that are typically traveling in the range of up to 80 ips in such systems.

As postage meters using digital print technology become more prevalent in the marketplace, it is important to find suitable substitutes for the mechanical print technology meters that have traditionally been used in high speed mail production systems. This need for substitution is particularly important as it is expected that postal regulations will require phasing out of older mechanical print technology meters, and replacement with more sophisticated meters. Although digital print technology exists that is capable of printing the requisite 300 dpi resolution on paper traveling at 80 ips, such devices are so expensive as to be considered cost prohibitive. Accordingly, it would be beneficial to have a solution that would allow lower velocity digital print technology, like thermal inkjet technology, to be utilized with the high speed mail production systems.

Some systems that have been available from Pitney Bowes for a number of years address some related issues. These systems utilize R150 and R156 mailing machines using 6500 model postage meters installed on an inserter system. The postage meters operate at a slower velocity than that of upstream and downstream modules in the system. When an envelope reaches the postage meter module, a routine is initiated within the postage meter. Once the envelope is committed within the postage meter unit, this routine is carried out without regard to conditions outside the postage meter. The routine decelerates the envelope to a printing velocity. Then, the mechanical print head of the postage meters imprints an indicia on the envelope. After the indicia is printed, the envelope is accelerated back to close to the system velocity, and the envelope is transported out of the meter.

One problem with this current solution is that the conventional postage meters are inflexible in adjusting to conditions present in upstream or downstream meters. For example, if the downstream module is halted as a result of a jam, the postage meter will continue to operate on whatever envelope is within its control. This often results in an additional jam, and collateral damage, as the postage meter attempts to output the envelope to a stopped downstream module.

Another problem with the current solution is that it is very sensitive to gaps between consecutive envelopes. This is because the R150 and R156 mailing machines are a bit too long to have time to carry out the routine on the envelopes, and to still have some margin for error in the arrival of a subsequent envelope. As such, a module with better space utilization and less sensitivity to gap variations is desirable.

SUMMARY OF THE INVENTION

The present application describes a system and a method to control the motion of envelopes within a postage printing module to accommodate the use of slower print techniques (digital or mechanical) in attempting to achieve high throughput in a mail processing system.

The system transports a first envelope at a nominal transport velocity to the postage printing module embodying the present invention. The postage printing module receives the envelope at the nominal transport velocity. When the envelope has passed completely into the control of the postage printing module it is decelerated to a predetermined lower print velocity for printing an image of a predetermined length. After the printing is complete the envelope is accelerated back to the transport speed and transported to a downstream module. None of the intervals of deceleration, low print velocity, or acceleration may occur while an envelope in the postage printing module is also in the control of another module.

In the preferred embodiment, the deceleration is activated by a sensor sensing the presence of the envelope at a trigger point. Further sensors at the upstream and downstream modules can be used to verify that no envelopes are under the shared control of the postage printing module and another module.

In another preferred embodiment, the print head is geared to operate in synchronism with the print transport, such that an image will not be distorted if there is a variation in print velocity.

The preferred system and method also provide a way to ensure that correct displacement is maintained between subsequent envelopes under the control of the invention in the event of a stop and/or restart of the system resulting from an exception condition, such as an envelope jam. When an envelope is within the print transport during an exception condition, the envelope must be decelerated to a stop, so as not to create further jams or collateral damage. In most modules in the system, a linear uniform deceleration is preferred to minimize disruption of the desired spacing between mail pieces being processed.

For the postage printing module, however, optimal performance using the present invention may require that deceleration not occur in the same uniform linear fashion as the rest of the system. Rather, deceleration is preferably controlled to maintain the relative displacement of envelopes in the postage printing module with respect to upstream and downstream modules. Because displacement varies in that module during normal operation, a uniform stopping and starting of the print module to mirror other modules will result in envelope spacing different than originally intended. Such changing in envelope gaps may result in further jams or misprocessing.

For this reason, the deceleration and acceleration resulting from the exception condition is controlled to maintain relative displacements as those displacements would have been if the exception condition had not occurred. To achieve this result, a controller in the print module controls the displacement of the print module according to a predetermined algorithm. This algorithm relates displacements of the print module with other modules for segments of the motion profile as they would have been executed during normal operation. During the exception condition, deceleration and acceleration of the print module is thus controlled as a predetermined function, or set of functions, of the displacements in other transport modules. The appropriate function is determined as a result of the position of the envelope in the print module during the course of the exception condition.

This displacement mapping functionality of the preferred embodiment operates cooperatively with the gearing of the print head mechanism to the print transport. In that preferred embodiment, stopping and restarting of the print module may not affect printing of an image on the envelope, even if a printing operation had already begun at the time of the stoppage.

The principles discussed herein are also applicable to a system condition in which the system is stopped without the occurrence of any problems. For example, the present invention may be applied in a situation where an operator simply wishes to turn off the system in order to take a lunch break, without waiting for the job to finish. Using the present invention, the process of routine stopping and starting of the system is simplified, and the risk of errors occurring from such stopping and starting is reduced. Therefore, it will be understood that the present invention applies equally to all stoppage conditions. Stoppage conditions include errors and exception conditions, as well as routine starting and stopping.

Further details of the present invention are provided in the accompanying drawings, detailed description and claims.

DETAILED DESCRIPTION

Figure 1:
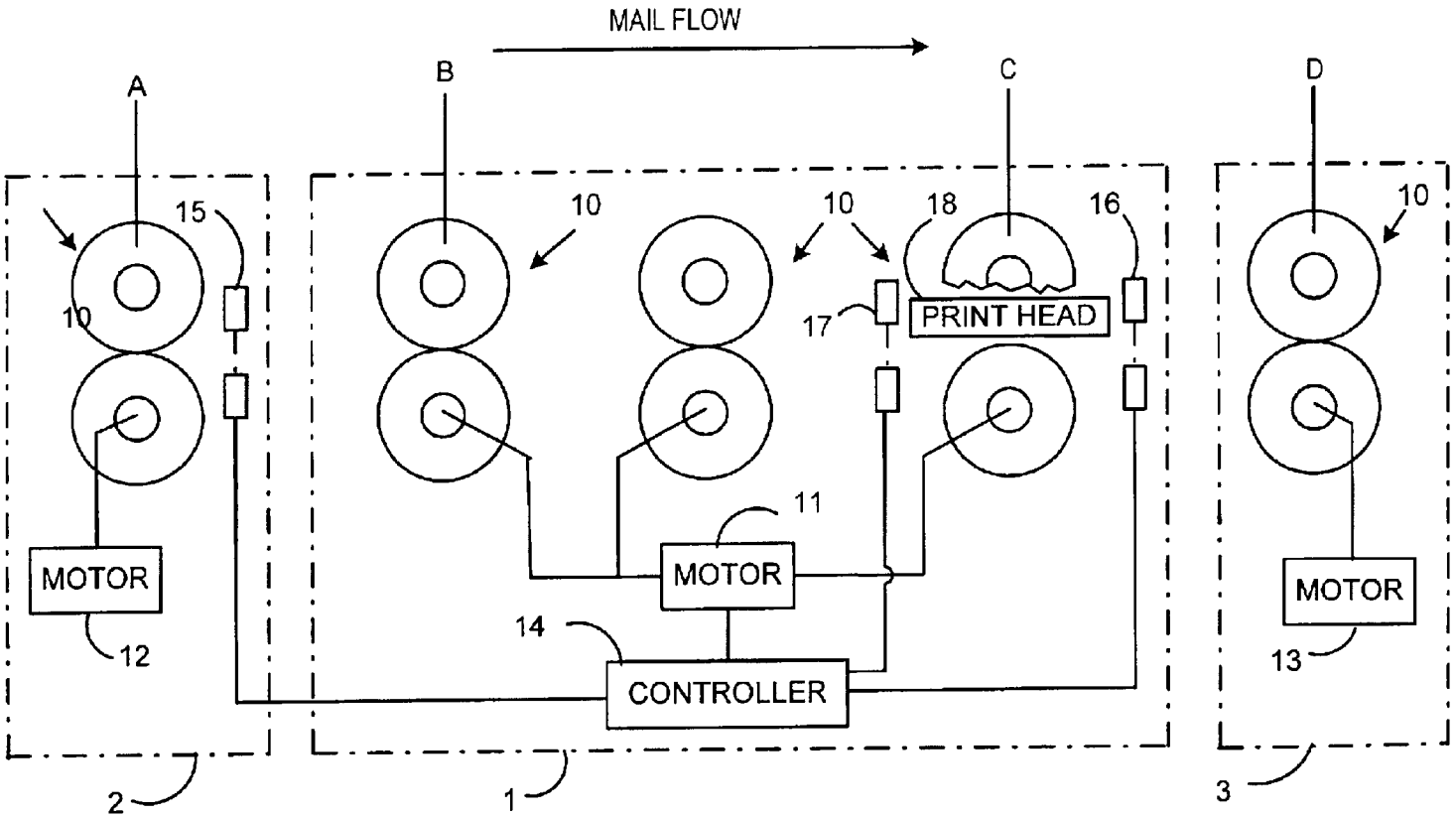
FIG. 1 is a diagrammatic view of a postage printing module in relation to upstream and downstream modules.

As seen in FIG. 1, the present invention includes a postage printing module 1 positioned between an upstream module 2 and a downstream module 3. Upstream and downstream modules 2 and 3 can be any kinds of modules in an inserter output subsystem. Typically the upstream module 2 could include a device for wetting and sealing an envelope flap. Downstream module 3 could be a module for sorting envelopes into appropriate output bins.

Postage printing module 1, upstream module 2, and downstream module 3, all include transport mechanisms for moving envelopes along the processing flow path. In the depicted embodiment, the modules use sets of upper and lower rollers 10, called nips, between which envelopes are driven in the flow direction. In the preferred embodiment rollers 10 are hard-nip rollers to minimize dither. As an alternative to rollers 10, the transport mechanism may comprise overlapping sets of conveyor belts between which envelopes are transported.

Print head 18 is preferably located at or near the output end of the print transport portion of the postage printing module 1 (see location C). To comply with postal regulations the print head 18 should be capable of printing an indicia at a resolution of 300 dots per inch (dpi). In the preferred embodiment, the print head 18 is an ink jet print head capable of printing 300 dpi on media traveling at 50 ips. Alternatively, the print head 18 can be any type of print head, including those using other digital or mechanical technology, which may benefit from printing at a rate less than the system velocity.

The rollers 10 for postage printing module 1, and modules 2 and 3 are driven by electric motors 11, 12, and 13 respectively. Motors 11, 12, and 13 are preferably independently controllable servo motors. Motors 12 and 13 for upstream and downstream modules 2 and 3 drive their respective rollers 10 at a constant velocity, preferably at the desired nominal velocity for envelopes traveling in the system. Thus in the preferred embodiment, upstream and downstream modules 2 and 3 will transport envelopes at 80 ips in the flow direction.

Motor 11 drives rollers 10 in the postage printing module 1 at varying speeds in order to provide lower velocity printing capabilities. Postage printing module motor 11 is controlled by controller 14 which in turn receives sensor signals including signals from upstream sensor 15, downstream sensor 16, and trigger sensor 17. Sensors 15 and 16 are preferably used to detect the trailing edges of consecutive envelopes passing through the postage printing module 1, and to verify that the printing motion control adjustment only occurs while a single envelope is within the postage printing module. Trigger sensor 17 determines that an envelope to be printed with an indicia is in the appropriate position to trigger the beginning of the print motion control scheme described further below.

Sensors 15, 16, and 17 are preferably photo sensors that are capable of detecting leading and trailing edges of envelopes. The preferred positioning of the sensors, and the utilization of signals received from the sensors are discussed in more detail below.

One aspect of the system relates to the relative positioning of the transport mechanisms between postage printing module 1 and the other modules. Referring to FIG. 1, the location of the output of the transport for upstream module 2 is location A. The location for the input to the print transport of postage printing module 1 is location B, and the output of the print transport mechanism for postage printing module 1 is location C. The input for the transport of downstream module 3 is location D.

In the exemplary embodiment shown in FIG. 1, the transport mechanisms are nip rollers 10 for each of the modules. Accordingly locations A, B, C, and D correspond to the respective locations of input and output nip rollers 10 in that embodiment. The modules may also include other rollers 10 at other locations, such as the set depicted in FIG. 1 between locations B and C. In the example depicted in FIG. 1, the three nip rollers sets 10 in postage printing module 1 will be driven by motor 11. To maintain control over envelopes traveling through the system, consecutive distances between rollers 10 must be less than the shortest length envelope expected to be conveyed. In the preferred embodiment, it is expected that envelopes with a minimum length of 6.5" will be conveyed. Accordingly and the rollers 10 will preferably be spaced 6.0" apart, so that an envelope can be handed off between sets of rollers 10 without giving up control transporting the envelope at any time. In particular, the predetermined length of 6.0" between rollers in useful between modules, i.e., between 1 and 2, and between 1 and 3, while it may be found to be beneficial to use lesser distances between rollers 10 within any one module.

Upstream sensor 15 is preferably located at or near location A, while downstream sensor 16 is preferably located at or near location C. Trigger sensor 17 is preferably located upstream from print head 18 by a sufficient distance to permit deceleration of the print transport from the nominal transport velocity to the print velocity upon the detection of a lead envelope edge. The trigger sensor 17 may be located any distance upstream from the minimum deceleration point, even as far upstream as upstream sensor 15, so long as the motion control profile determined by controller 14 is adjusted accordingly.

Controller 14 controls the motor 11 in accordance with a print motion control profile in order to achieve the goals of (1) reducing the speed of an envelope so that the low velocity print head 18 can print an indicia, and (2) controlling the motion of the envelopes so that consecutive envelopes to not interfere with each other. A preferred embodiment of a print motion control profile for use with the present invention is depicted in FIG. 2.

Figure 2:
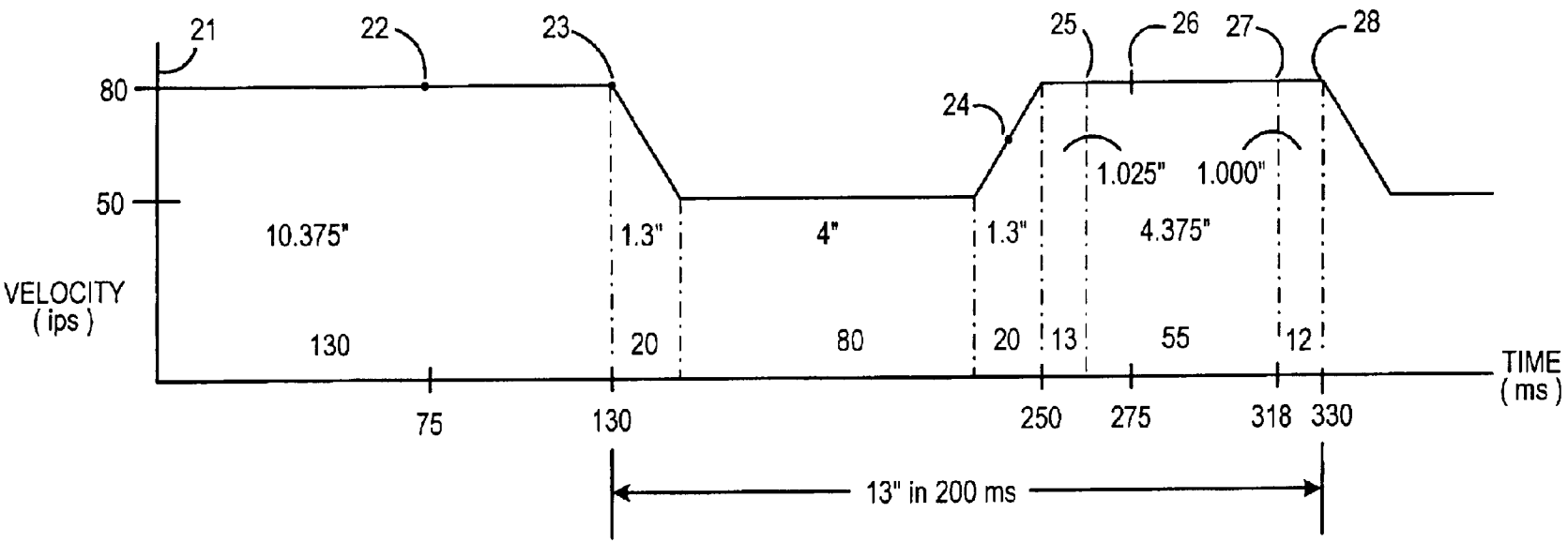
FIG. 2 is a graphical representation of a print motion control profile for controlling the speed of envelopes in the postage printing module.

FIG. 2 is a graph of velocities of the nip roller sets 10 at locations B and C while processing envelopes. Notations provide the translation distances provided by print transport for different intervals. The depicted profile is based on a system that is printing on envelopes 10.375" inches in length, that requires a maximum length printed indicia of 4". The nominal transport velocity is 80 ips, and the print velocity is 50 ips. The accelerations for adjusting speeds are 3.88 G's, or 1500 in/s$^2$. At the nominal transport speed the period between envelopes is 200 ms. The print head 18 is located just upstream of nip roller set 10 at location C.

At point 21 on the profile, a lead edge of a first envelope reaches the output of the upstream module 2, at location A. In this exemplary profile, there is no envelope to be printed in the cycle before the first envelope. After crossing between the six inch gap between the module transports, at point 22 the lead edge of the first envelope is at location B. At point 22 the first envelope is under the control of both upstream module 2 and print module 1, and there can be no unilateral change in velocity of the print module transport. Sensors 15 and 16 can provide signals to controller 14 to prevent initiation of a change in velocity while an envelope is under the control of more than one module.

At point 23 on the motion profile, the tail end of the first envelope is just leaving the upstream module 2. Since the first envelope is under the sole control of the print module 1, the print transport may slow down to allow the slower velocity printing. Controller 14 can begin the necessary deceleration by sensing the lead edge of the first envelope with the trigger sensor 17. Alternatively, the deceleration can begin as a result of upstream sensor 15 detecting the tail end of the first envelope has left upstream module 2. In this alternate arrangement, the length of the print module 1 can be minimized because the low velocity print operation can be initiated and finished as soon as possible. Because conservation of floor space, or "footprint," is typically important with a mail processing system, the preferred embodiment is designed to minimize the length of the device necessary.

After point 23, the nips 10 of the print module 1 initiate a predetermined deceleration to reach the desired print velocity, in this case 50 ips. The print transport then operates at 50 ips to transport the envelope a predetermined distance while an indicia is printed on it. In this exemplary embodiment the print distance is four inches. After the predetermined print distance has been completed, the envelope is accelerated back to the transport speed.

At point 24, during the acceleration portion of the motion profile, the tail end of the first envelope leaves the nips 10 at point B, and the envelope is under the exclusive control of the nips 10 at point C. Shortly thereafter, the lead edge of the first envelope reaches the first nip of the downstream module 3, at location D, as indicated at point 25 in FIG. 2. At this point in time, the first envelope is under the control of modules 1 and 3 and variations in the print transport speed are not permissible.

At point 26, a second envelope enters the print module 1 at location B. At that particular time, and shortly thereafter, two envelopes are being handled by the nips 10 in print module 1. This is permissible, so long as no speed variations are initiated while one or both of the envelopes are under the control of more than one module.

At point 27, the first envelope completely leaves print module 1, allowing that the motion control profile for the second envelope can begin at an appropriate time. At point 28, the motion control profile for the second envelope can begin because the tail end of the second envelope has left the upstream module 2, and is under the control of print module 1.

Using the motion profile depicted in FIG. 2, envelopes can be slowed for lower speed printing, but without having subsequent envelopes collide. The nominal distance between envelopes for the example described would be 5.625 inches ((80 ips)*(0.200 s)−10.375 inches) before entering the print module 1. After performing the print motion profile, the minimum distance between envelopes is reduced to 2.625 inches (5.625 inches−(80 ips)*(0.120s)−1.3 inches−4.0 inches−1.3 inches). However, the nominal distance is restored as the subsequent envelope has the same motion profile performed on it, and the prior envelope travels away at the nominal travel velocity of 80 ips. Accordingly, the throughput of the system remains intact.

The exemplary motion profile described above complies with requirements necessary for a successful reduced velocity print operation. As mentioned above, when print speed adjustment is performed on an envelope, print module 1 must have total control of the envelope. For example, the envelope cannot reside between nip rollers 10 at location A or D during execution of the print motion control profile. Additionally, in the preferred embodiment, envelopes upstream and downstream of the envelope must be completely out of print module 1, i.e., they cannot reside anywhere between nip rollers 10 between locations B and C during the execution of the print motion profile. Accordingly, in the preferred embodiment, print module 1 will only perform the print motion control profile (1) after the trail edge of the envelope has exited upstream module 2 at location A; and (2) after the trail edge of the downstream envelope has exited print module 1. Similarly, in the preferred embodiment, print module 1 must complete the print motion control profile (1) before the lead edge of the upstream envelope has reached print module at location B; and (2) before the lead edge of the envelope has reached the downstream module 3 at location D.

In practice, these requirements will limit the range of lengths for postage printing module 1 in order that it can process envelopes of the desired sizes at the desired speed.

In the preferred embodiment, the minimum and maximum expected envelope lengths are 6.5 and 10.375 inches respectively. As discussed above, in order to always maintain control of the smallest envelope, the distance between location A and B and the distance between location C and location D will be 6.0" in the preferred embodiment of the present invention. The minimum length between the end of upstream module 2 at location A and the end of print module 1 at location C in the print module I is determined by adding the maximum document length plus the minimum necessary acceleration distance for execution of a motion profile. In this case those distances are 10.375"+1.3", or 11.675".

To calculate the minimum length of the print transport between locations B and C, simply subtract the known distance between location A and B of 6", to arrive at a minimum length of 5.675".

A conservative estimated acceleration of 3.88G's, or 1500 in/sec$^2$, has been selected for the preferred embodiment. This acceleration may be increased or decreased based on the needs of the system. Based on this linear deceleration and acceleration that the print transport travels 1.3 inches while the transport is changing from its transport velocity of 80 ips to the print velocity of 50 ips and back again.

In a further preferred embodiment of the present invention, to ensure accurate printing, the rate at which the print head 18 prints the indicia can be electronically or mechanically geared to the speed of the print transport in the print module 1. In such case, under circumstances where the print transport is operating outside of nominal conditions, a correct size and resolution print image can be generated. In the electronic version of this preferred embodiment, controller 14 and servomotor 11 are geared to the same velocity and timing signals to provide that the transport and printing are always in synchronism.

Another preferred embodiment of the present invention addresses a problem that occurs when the print module 1 is forced to deviate from the motion control profile depicted in FIG. 2. For example, in a conventional inserter system, when an envelope jam occurs downstream from the postage printing module, upstream and downstream modules typically come to a halt in accordance with a uniform rapid linear deceleration profile. Unfortunately, in conventional inserter systems, the postage printing modules have no mechanism for halting envelopes that are committed within the postage meter. As a result, additional paper jams and damaged envelopes commonly occur as the postage printing module forces envelopes against a halted downstream module.

To address this problem, in the preferred embodiment of the present invention the print module 1 will also decelerate to a stop upon the occurrence of an exception event. Such exception events may include detection of jams, detection that mail pieces are out of order, or detection of equipment malfunctions. If the print head 18 is geared to the print transport motor 11, then an envelope can be stopped anywhere in the print module 1 upon the occurrence of an exception event without damaging the envelopes, and without compromising the image to be printed on the envelope. After the error condition has passed, print module 1 can be accelerated back to the velocities in accordance with the motion profile depicted in FIG. 2.

A uniform linear deceleration and acceleration during an exception condition is preferred for the upstream and downstream modules 2 and 3. However, a deceleration and acceleration having that same uniform linear profile may cause problems in print module 1. For example, if the print transport was about to reach point 23 in the motion profile of FIG. 2 when the exception condition occurred, the print transport could decelerate down to zero velocity in a linear fashion the same as modules 2 and 3. However, after the exception condition has been cleared, the envelope in the print module 1 will be closer to the downstream module than it would have been if the normal motion profile had been executed. This is because during the uniform deceleration, the print module I has essentially skipped a portion of the motion profile. During this "skipped" portion, it was intended that the envelope decelerate to the print velocity. A result of that deceleration would have been an increase in the gap with a downstream envelope and a decrease in a gap with an upstream envelope. A uniform shutdown profile for all modules interferes with this planned variation in gap sizes.

Accordingly, the present invention maintains the expected displacements between consecutive documents by controlling the transport of envelopes in print module 1 as a function of the displacement positions of upstream and/or downstream modules 2 and 3. Thus, the variations in velocity that result from the stoppage and starting in an exception condition should not affect the relative spacing of the envelopes. In the equations provided below for determining the appropriate displacement relationship, the velocity variables will be eliminated, and positions of the transports expressed in terms of variable displacements and known constants.

To achieve this desired result, the desired displacements of the print module 1, as they would have resulted from performance of the motion profile under nominal conditions, must be describable in terms of the position of upstream or downstream modules. Also, the descriptions must be expressed in terms of the displacement relationships that would have resulted from the distinct segments in the motion profile.

For example, for the portion of the motion profile where the print module 1 should operate at the transport velocity, there should be a one-to-one correspondence in the displacements produced by an upstream module 2 and print module 1. Thus, if an exception condition occurs while an envelope is at a location within the print module 1 where it would normally be traveling at the transport velocity, then the deceleration of the print module 1 during an exception condition will mirror that of the upstream module 2. For this exemplary situation, the equation relating the displacement position of the print module 1, "$P_1$," to the displacement position of the upstream module 2, "$P_2$," will be:

$$[1] P_1=P_2.$$

If the envelope is located at a position where it would normally be subject to deceleration in preparation for a printing operation, then, during an exception condition, print module 1 must decelerate more quickly than upstream module 2 in order that the shortening of the gap between envelopes in those modules be preserved. To derive the appropriate displacement relationship for this segment of the print module 1 motion, the following symbols are defined:

v=velocity of the print module 1 transport;

$v_{transport}$=the transport velocity for the system, (nominally 80 ips);

$v_{print}$=the print velocity for print module 1 during the printing segment of the motion profile (nominally 50 ips);

$a_1$=acceleration that print module 1 would normally undergo in the deceleration segment of the motion profile (deceleration being a negative value acceleration) (nominally −1500 in/sec$^2$);

a2=acceleration that print module 1 would normally undergo in the acceleration segment of the motion profile (nominally 1500 in/sec$^2$);

$p_{decel}$=the displacement that print module 1 normally undergoes during the deceleration portion of the motion profile (nominally 1.3 inches); and $p_{accel}$=the displacement that print module 1 normally undergoes during the acceleration portion of the motion profile (nominally 1.3 inches).

During normal operation in accordance with the motion profile, the displacement position, $P_1$, of the print module 1, starting at the beginning of the deceleration segment, is described according to the equation:

$$[2] P_1=(v^2-v_{transport}^2)/2a_1$$

An expression can also be derived relating the velocity, v, of print module 1 as a function of the displacement position, $P_2$, of upstream module 2, during normal operation of the deceleration portion of the motion profile:

$$[3] v=((v_{print}-v_{transport})/p_{decel})P_2+v_{transport}$$

Thus, an equation relating $P_1$ and $P_2$, independent of instantaneous velocities, is derived by substituting the value of "v" derived in equation [3] into equation [2]. Performing this substitution, displacement relationship between print module 1 with upstream module 2, for the deceleration segment of the motion profile is:

$$[4] P_1=((((v_{print}-v_{transport})/p_{decel})P_2+v_{transport})^2-v_{transport}^2)/2a_1$$

Using this relationship in equation [4], controller 14 of print module 1 can adjust the displacement of print module 1 when an envelope is present at a location where it normally would undergo the deceleration portion of the motion profile.

The next segment of the motion profile for discussion is the printing portion. During that segment the envelope is transported at a constant velocity, $v_{print}$. Accordingly, for that segment, the relative displacements that would be seen in upstream module 2 and print module 1 would be described as a fixed ratio. This relationship is described by the following equation:

$$[5] P_1=(v_{print}/v_{transport})P_2.$$

It should be noted that the appropriate displacement relationship may change while the print module 1 is decelerating to a stop. For example, an envelope that is slightly upstream of trigger sensor 17, and traveling at the transport velocity, may begin to stop in accordance with the displacement relationship described in equation [1], above. However, during the deceleration, but before stopping, the envelope may reach the trigger position marked sensor 17. After the trigger sensor 17 has been reached controller 14 will switch the displacement relationship to that described in equation [4] above. Thus, as many different displacement relationships may be utilized as may be necessitated by the positions reached by the envelope during the deceleration process. Thus, if the deceleration were protracted to reach a location where a printing segment was intended, then displacement may be controlled in accordance equation [5] above. Also, based on the gearing of the print head 17 with the motor 11, the print head may begin printing a portion of the image on the envelope before it stops. When the print module 1 restarts, the geared print head will also resume printing at the appropriate geared speed.

A final segment of the motion profile is the acceleration of the envelope from the print velocity, back to the transport velocity. The displacement mapping relationship for this segment can be derived in the same way as for equation [4] above. A difference in the result being that this acceleration segment is causing an envelope in the print module 1 to increase its distance from a subsequent envelope in upstream module 2. Accordingly, the displacement relationship when an envelope is at the acceleration motion profile segment during a stopping or restarting condition is as follows:

$$[6] P_1=((((v_{transport}-v_{print})/p_{accel})P_2+v_{print})^2-v_{print}^2)/2a_2$$

Displacement information for respective print, upstream, and downstream modules 1, 2, and 3 may typically be monitored via encoders in motors 11, 12, and 13. The encoders register the mechanical movement of the module transports and report the displacements to controller 14 for appropriate use by controller 14 to maintain correct displacement mapping between the modules.

In this application, a preferred embodiment of the system has been described in which documents being processed are envelopes. It should be understood that the present invention may be applicable for any kind of document on which printing is desired. Also a package or a parcel to which a printed image is applied as part of a processing system should also be considered to fall within the scope of the term "document" as used in this application.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A printing system for use in a high velocity document processing system using lower velocity print technology, the system comprising:

a transport path comprising an upstream transport conveying documents at a transport velocity, a downstream transport conveying documents at the transport velocity, a print transport located between the upstream transport and the downstream transport, the print transport driven independently of the upstream transport and the downstream transports, the transport path periodically stopping as a result of stoppage conditions detected in the document processing system;

a print head contiguous with the print transport to print on documents transported thereon;

the print transport controlled by a controller according to a predetermined motion profile, whereby under nominal conditions the print transport decelerates the print transport to a nominal print velocity prior to a printing operation in a first segment, maintains the nominal print velocity during the printing operation in a second segment, and accelerates the print transport back to the transport velocity after completion of the printing operation in a third segment; and the print transport further controlled by the controller to decelerate to a stop upon the occurrence of a stoppage condition in the document processing system, the deceleration controlled by the controller in accordance with a predetermined algorithm to maintain a relative displacement of the documents on the print transport with respect to upstream or downstream transports to maintain the relative displacements that would have occurred under the predetermined motion profile under nominal conditions, the predetermined algorithm determining the displacement of the print transport as a function of displacement of upstream or downstream transports.

2. The printing system in accordance with claim 1 wherein the controller further controls the print transport to accelerate from a stop back to nominal condition upon the occurrence of a restart after the stoppage condition, the acceleration controlled by the controller in accordance with the predetermined algorithm to maintain the relative displacement of the print transport with respect to upstream or downstream transports to maintain the relative displacements that would have occurred under the predetermined motion profile under nominal conditions, the predetermined algorithm determining the displacement of the print transport as a function of displacement of upstream or downstream transports.

3. The printing system of claim 2 wherein the print head is electronically or mechanically geared to the print transport so that variations in print transport velocity during a printing operation will not affect an image being printed.

4. The printing system of claim 2 wherein the predetermined algorithm for determining relative displacements includes a first function for accounting for changes in relative displacements that would have occurred during deceleration of the print transport in the first segment of the motion profile, a second function for accounting for changes in relative displacements that would have occurred during the reduced nominal print velocity of the second segment of the motion profile, and a third function for accounting for changes in relative displacements that would have occurred during acceleration of the print transport in the third segment of the motion profile, the appropriate of the first, second, and third functions being invoked by the controller based on the position of a document in the print transport during the occurrence of the stoppage condition.

5. A printing system for use in a high velocity mail processing system using lower velocity print technology, the system comprising:

a transport path comprising an upstream transport conveying envelopes at a transport velocity, the upstream transport having an upstream output location at the most downstream end of the upstream transport, a downstream transport conveying envelopes at the transport velocity, a print transport located between the upstream transport and the downstream transport, the print transport velocity driven independently of the upstream transport and the downstream transport a print head proximal to a downstream end of the print transport;

a sensor arrangement comprising an upstream sensor proximal to the upstream output location and determining a presence of an envelope within the print transport portion of the transport path and generating a sensor signal;

a controller receiving the signal from the sensor arrangement and controlling velocity of the print stream transport based on the sensor signal, the controller maintaining the print transport at the transport velocity when an envelope arrives from the upstream transport, decelerating the print transport prior to the envelope reaching the print head, maintaining a print velocity of the print transport while the print head prints on the envelope for a predetermined length, and accelerating the print transport back to the transport speed for the envelope to be received by the downstream transport, and wherein and the controller will not begin deceleration of the print transport until the upstream sensor provides a signal that a tail end of the envelope has passed the upstream sensor.

6. The printing system of claim 5 wherein:

the print transport further comprises a print output location at the most downstream end of the print transport; and wherein the sensor arrangement further comprises an print exit sensor proximal to the print output location, and the controller will not begin deceleration of the print transport for a subsequent envelope until the print exit sensor provides a signal that a tail end of the envelope has passed the print exit sensor.

7. The printing system of claim 5 wherein:

the print transport further comprises a print output location at the most downstream end of the print transport; and wherein the sensor arrangement further comprises an print exit sensor proximal to the print output location, and the controller will not begin deceleration of the print transport for a subsequent envelope until the print exit sensor provides a signal that a tail end of the envelope has passed the print exit sensor.

8. The print system of claim 5 wherein the print head is geared to operate at a same velocity as the print transport.

9. The print system of claim 8 wherein the print head is mechanically geared to the print transport.

10. The print system of claim 8 wherein the print head is electronically geared to the print transport.

11. A method for printing in a high velocity mail processing system using lower velocity print technology, the method comprising:

transporting a first envelope at a transport velocity in an upstream transport;

transferring the first envelope from the upstream transport to a print transport at the transport velocity;

after the first envelope is no longer in the control of the upstream transport, decelerating the first envelope to a print velocity;

printing on a predetermined length of the first envelope as it passes under a print head at the print velocity;

after printing the predetermined length, accelerating the first envelope to the transport speed;

transferring the first envelope to a downstream transport at the transport velocity;

after control of the first envelope has been transferred to the downstream transport, decelerating a subsequent second envelope in the print transport to the print velocity; and gearing the print head to operate in direct relationship with the velocity of the print transport.

12. A method for printing in a high velocity document processing system using lower velocity print technology, the method comprising:

transporting a document at a transport velocity in an upstream transport to a print transport;

transporting the document on the print transport;

transporting the document at the transport velocity in a downstream transport from the print transport;

printing an image on the document transported on the print transport while the document is within the print transport during nominal system conditions, controlling the velocity of the print transport in accordance with a motion profile, whereby the motion profile includes the steps of decelerating the document to a print velocity, maintaining the print velocity during the step of printing, and accelerating the document to the transport velocity after the step of printing is complete, the motion profile resulting in a relative displacement of the document with respect to upstream and downstream documents to vary during the motion profile; and while the document is within the print transport during a stoppage condition, decelerating the document to a stop, the step of decelerating to the stop including the step of maintaining the relative displacement of the document on the print transport with respect to upstream and downstream documents, the step of maintaining the relative displacement including controlling the deceleration according to a predetermined algorithm describing relative displacement between documents as such displacement would have occurred under the motion profile under nominal conditions, the predetermined algorithm determining the displacement of the print transport as a function of displacement of upstream or downstream transports.

13. The printing method in accordance with claim 12 further comprising the steps of:

restarting the print transport while the document is within the print transport during the stoppage condition, the step of restarting including the step of accelerating the document from the stop to a velocity of the motion profile, the step of accelerating including the step of maintaining the relative displacement of the document on the print transport with respect to upstream and downstream documents, the step of maintaining the relative displacement including controlling the acceleration according to the predetermined algorithm.

14. The printing method of claim 13 including the step of electronically or mechanically gearing the printing step to the print transport motion so that variations in print transport velocity during the printing step will not affect the image being printed.

15. The printing method claim 13 wherein the predetermined algorithm for determining relative displacements including a first function accounting for changes in relative displacements that would have occurred during deceleration of the print transport in the first segment of the motion profile, a second function accounting for changes in relative displacements that would have occurred during the reduced nominal print velocity of the second segment of the motion profile, and a third function accounting for changes in relative displacements that would have occurred during acceleration of the print transport in the third segment of the motion profile, and the method further including the step of invoking the appropriate of the first, second, and third functions based on the position of the document in the print transport during the occurrence of the stoppage condition.

* * * * *